US005342055A

United States Patent [19]

Diley

[11] Patent Number: 5,342,055

[45] Date of Patent: Aug. 30, 1994

[54] GOLF PUTTING TRAINING DEVICE

[76] Inventor: Mark J. Diley, 18540 Queen Elizabeth Dr., Brookeville, Md. 20833

[21] Appl. No.: 149,539

[22] Filed: Nov. 9, 1993

[51] Int. Cl.[5] ..... A63B 69/36

[52] U.S. Cl. ..... 273/187.2; 273/192

[58] Field of Search ..... 273/191 R, 77 A, 187.2, 273/192, 186.2, 186.3, 187.4, 187.6, 191 B

[56] References Cited

U.S. PATENT DOCUMENTS 3,891,212 6/1975 Hill ..... 273/77 A X 4,399,994 8/1983 Hourihan ..... 273/191 R

*Primary Examiner*—George J. Marlo

*Attorney, Agent, or Firm*—Aquilino & Welsh

[57] ABSTRACT

A device for teaching a golfer a putting stroke along a preselected path while maintaining the putter head in a precise relationship to the path, including an elongated rod having a neck-engaging member and a quick release connector for attaching the rod to the putter head. The length of the rod is adjustable and defines the radius of the arc of motion of the club relative to the golfer, whereby a putter is constrained by the device to swing in a precisely defined path to teach the golfer a repetitive stroke. An indicator loop attached to the rod enables the golfer to monitor the position of the putter shaft within the loop as a putting stroke is made.

11 Claims, 2 Drawing Sheets

FIG. 3
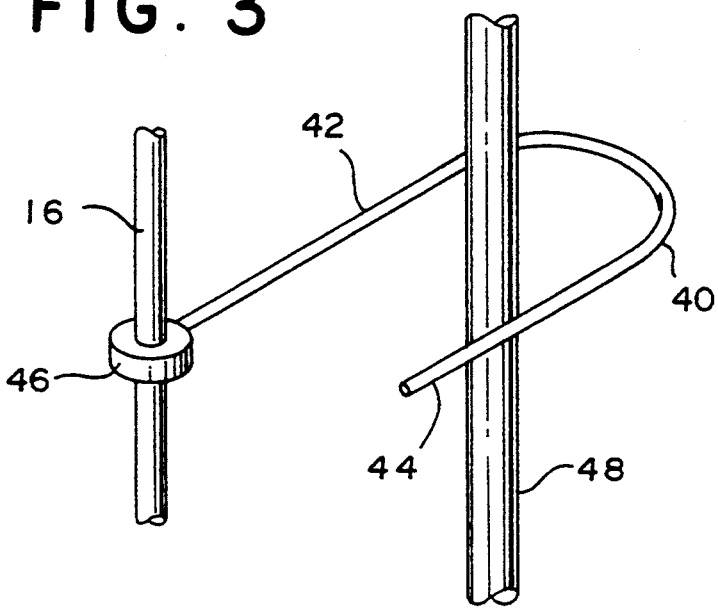
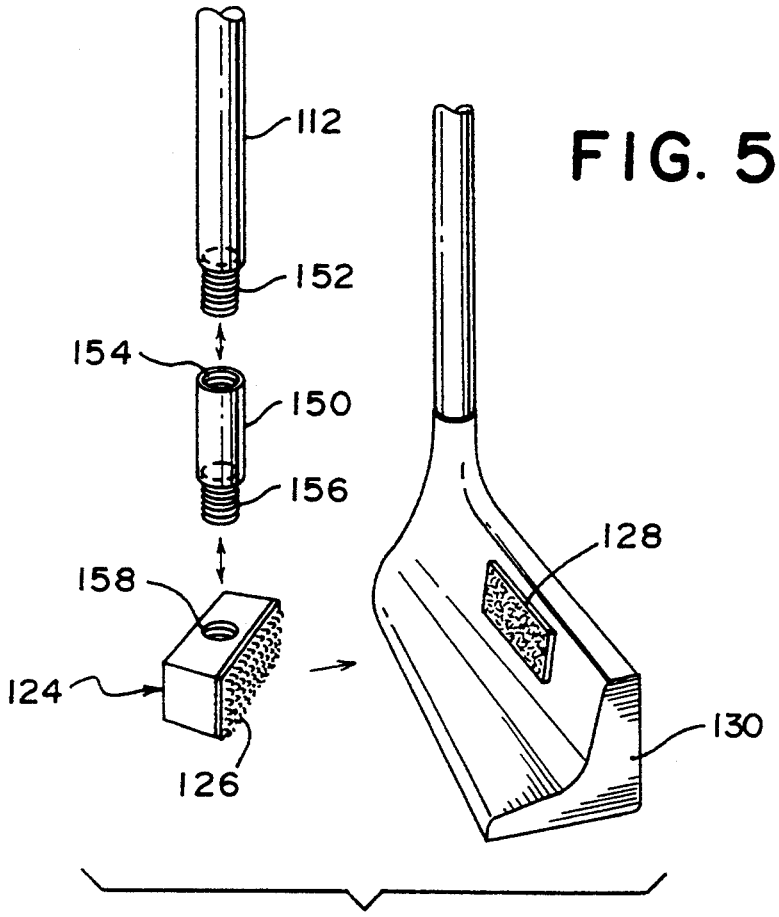
FIG. 4
FIG. 5
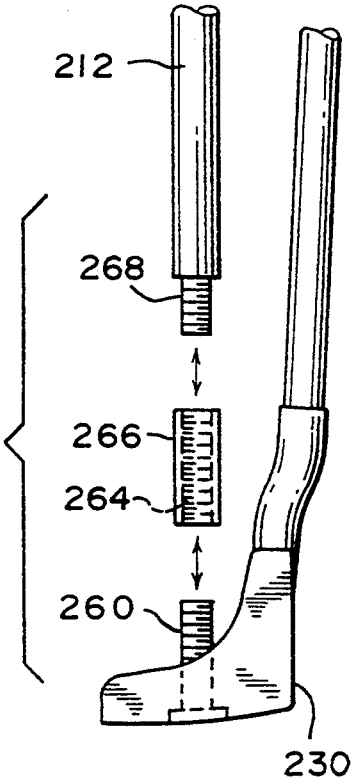

GOLF PUTTING TRAINING DEVICE

BACKGROUND AND DESCRIPTION OF THE INVENTION

The present invention relates to a golf training device, and in particular, to a golf putting training device for teaching a player to make a repetitive putting stroke.

In playing the game of golf, the putting stroke presents anywhere between 30 and 50 percent of the total number of strokes taken during a round. Whereas there are a number of factors which determine whether or not a putt finishes in or close to the hole, the most of these in importance is the path that the putter head takes during the execution of the stroke. In order to be consistent in striking the ball so that it rolls on the preselected path, there are several conditions which must be met. First, the putter must be swung on a consistent path. Second, the putter must strike the ball at or near the center of percussion of the club head, and the blade of the putter must be held in precise alignment with the target line.

The present invention provides a device which aids in the training of a golfer to swing a putter in a precise, defined, preselected path in order that the club strikes the ball consistently on the center of percussion, and with the putter face precisely aligned to the target. This is accomplished by attaching one end of the device of the present invention directly to the putter head itself, and engaging the head of the user with the other end of the device to provide stability and a premeasured arc length to create the proper swing.

There are a number of prior art devices which use various body engaging parts to aid a golfer in swinging a golf club on a predetermined path. For example, the patent to Stawicki (5,150,901) relates to a training device, including a harness attachable to the upper torso of a golfer and an elongated tubular golf swing guiding member which is connected to the grip portion of the club, enabling the player to swing the club around a centrally defined position relative to the golfer's chest.

Another patent of interest is to Radakovich (5,149,099), which shows a golf swing training device which includes an elastic loop connected over the shoulders and chest of the player, whereby the handle end of the club is laid inside an elastic loop and pushed downward and outward by the arms, stretching the loop so that swinging the golf club against the upward pull of the elastic loop produces a control of the golfer's arm to provide a desired swing plane.

The patent to Schaus (3,677,551) relates to a golf training device including a base plate for locating or positioning the feet of the golfer and a loop for encircling the neck, connected by a flexible link. The link includes a breakaway coupling which will disengage if an incorrect golf swing occurs.

Still another patent to Oppenheimer (3,595,583) shows a device for practicing a swing for which the golf club shaft is secured to extend forwardly of the player, using a body attached linkage connected to the club head to define the arc of the swing.

Another golf training device is shown in the patent to Fisher (3,442,513) using a base on which the golfer stands, a neck-engaging loop and body-engaging belt, all of which are interconnected by an elastic loop to maintain the golfer in a preselected, desired position.

The patent to Webster (2,103,502) shows a golf training harness including a belt worn around the waist of the golfer and a cord attached between the belt and the club head to define the art of the swing.

Finally, a golf training device is shown in the patent to Hourihan (4,399,994), for constraining the club to swing to a predetermined radius arc. The device includes an elongated telescoping member having a ring or loop which encircles the golfer's neck, and a bracket on the opposite end which is attached to the shaft of the club head adjacent the club head. The telescoping members are spring-biased together, and when the player swings the club through a stroke, the loop defines the center of arc of motion and the length of the shaft determines the length of the arc through which the golf club is swung.

The present invention is directed to a golf putting training device which represents an improvement over the prior art. The training device of the present invention teaches a player to make a repetitive, consistent putting stroke by developing muscle memory as the device is being used to practice putting. The golf putting training device includes a neck engaging loop attached to one end of a telescoping rod. The opposite end of the rod attaches directly to the head of the putter using a novel attachment member which permits quick attachment and release so that the club may be used with and without the practice device, with a minimum of effort. Preferably, the attachment member includes a separable fastener of the hook-and-loop type or other similar engaging members, as defined, for example, in U.S. Pat. Nos. 2,717,437, 3,009,235, 4,541,154, 4,709,453, 5,032,122, 5,040,275, 5,067,210, 5,131,119 and 5,212,853, among others.

Preferably, one portion of the separable fastener may be permanently attached to the club head for engagement with a complementary fastener member attached to the free end of the rod. The present invention also includes a shaft alignment indicator attached directly to the rod, which enables a golfer to determine the position of the golf club shaft as a putting stroke is made.

In a preferred embodiment, the golf putting training device of the present invention is formed of a sectional telescoping rod of aluminum or other lightweight material having a friction joint between the telescoping members to allow quick and precise adjustment of the members relative to each other while the device is being worn on the neck to ensure that a precise and accurate length of arc is created. The end of the telescoping rod formed in the shape of an open ended loop is easily placed on and removed from the neck of the user. The opposite end of the rod is provided with an attachment member for attachment to the head of a putter. The attachment member may be frictionally held or otherwise attached to the rod and includes a planar surface to support a suitable separable fastener pad.

A second separable fastener pad is preferably permanently attached to a putter at a position determined by the shape of the putter head. For example, if a blade-type putter is being used, the separable fastener pad may be attached directly to the rear face. If a mallet-type putter is being used, the separable fastener may be attached directly to the top surface of the putter head, and if a flange-type putter is being used, the separable fastener may be attached directly to either the rear face or the flange or to both surfaces of the putter. The attachment member on the end of the rod may be shaped or sized to precisely fit the putter head in which the practice device is being used.

In use, the device is placed on the neck of the user and the opposite end is attached directly to the club head. This establishes a constant radius for the putting stroke. As the golf club is swung, the training device rotates around the user's neck, thereby keeping the club head at a constant radius from the user's body, and maintaining the club face precisely aligned to the intended target line.

Among the objects of the present invention are the provision of a golf putting training device to teach a golfer to make a repetitive putting stroke and develop muscle memory thereby.

Another object of the present invention is to provide a golf swing training device for teaching a golfer a putting stroke whereby the putter head is constrained to swing through a predetermined arc or radius during the execution of a putting stroke.

A still further object of the present invention is to provide a golf swing training device which is simple and easy to use, and which may be readily attached and detached from the golf club.

A further object of the present invention is the provision of a golf swing training device which enables a golfer to determine the position of the club head shaft relative to the radius of a perfect swing arc.

These and other objects of the present invention will become apparent with reference to the following drawings and written description.

BRIEF DESCRIPTION OF THE DRAWINGS

FIG. 3 is a detail of an indicator used with the device of FIG. 1.

FIG. 4 is a detail of an alternate embodiment of the present invention.

FIG. 5 is a detail of a second alternate embodiment of the present invention.

DESCRIPTION OF THE PREFERRED EMBODIMENTS

Figure 1:
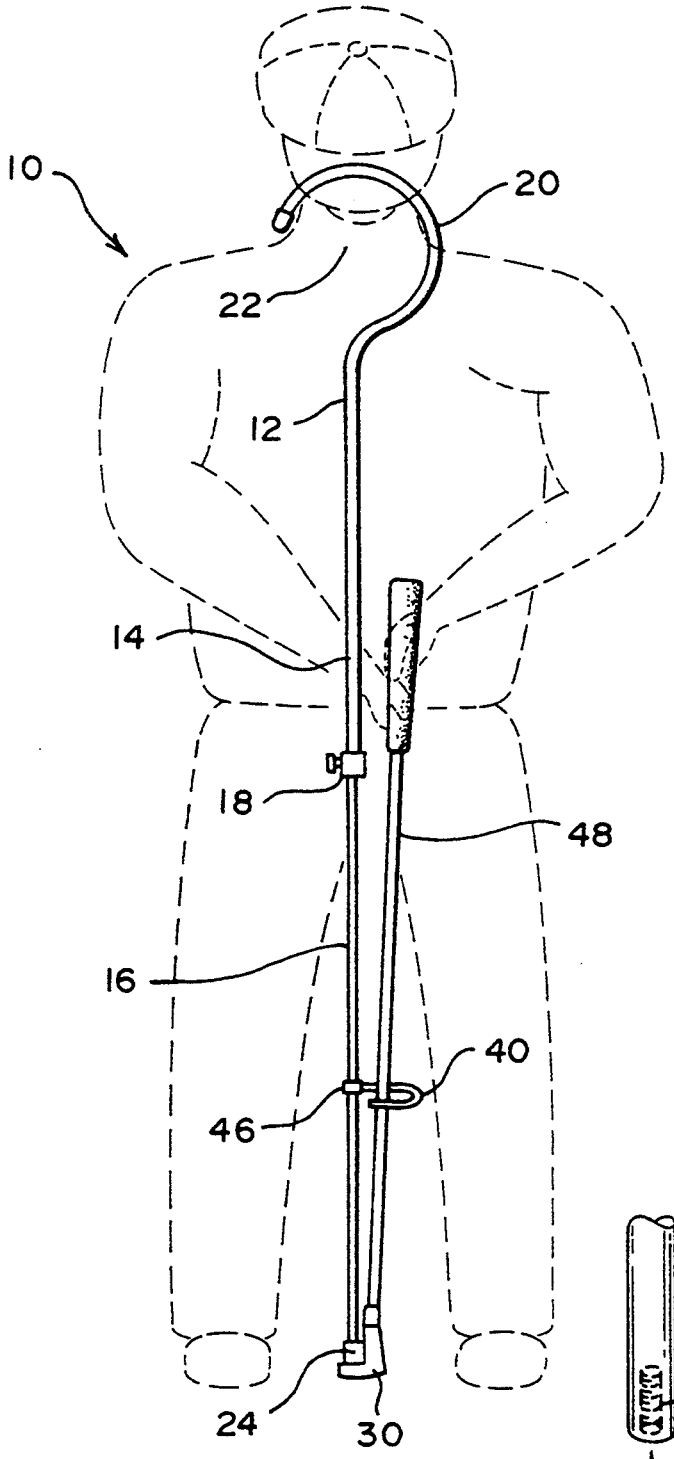
FIG. 1 is a perspective view of the training device attached to a putter as it is used with a golfer shown in phantom lines.

The detailed embodiments of the present invention are disclosed herein, however, it is to be understood that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

The golf practice device of the present invention enables a golfer to practice a repetitive putting stroke which creates a muscle memory pattern in order that the player be able to repeat the stroke during actual conditions when playing the game of golf.

Referring to the drawings, the golf practice device 10 is formed of an elongated central rod 12 formed of telescoping sections 14 and 16 which are frictionally held together at a joint 18. The sections 14 and 16 are relatively moveable longitudinally with respect to each other so that the overall length of the central rod 12 may be adjusted to accomodate the height of a particular user. The upper end of the rod 12 is provided with a hook member 20 having an opening 22 which enables the hook member 20 to be placed around the neck of the user. The hook member 20 is sized so as to comfortably fit the user, and the opening is sufficiently large to enable it to be easily placed on and taken off a user's neck.

Preferably, the rod 12 is made from lightweight aluminum tubing, although it will be appreciated that any suitable metallic or rigid plastic material will operate equally well for the purposes of the present invention, the only requirement being that the rod be of sufficient strength and rigidity for the purposes described hereinbelow.

The opposite end of the rod 12 is provided with an attachment member 24 for attachment directly to a golf club putter head. Preferably, the attachment member 24 includes one complementary separable fastener pad 26, for example, of the hook-and-loop type, or mushroom type, as disclosed in the patents discussed hereinabove. A second complementary separable fastener pad 28 is attached to the head of a putter type golf club 30, preferably by gluing or by using double-sided adhesive tape or similar fastener material. The separable fastener pad 28 on the club head may be permanently attached or may be removable for use on other putter type golf clubs. The attachment member 24 may be permanently attached to the end of the rod 12 or may be removable, for example, by using a threaded fastener 32 which is connected to a threaded bore 34.

In a preferred embodiment, the attachment member 24 may be removably attached to facilitate connection to the club head and/or replacement of the separable fastener connector material.

The practice putting device 10 is used by placing the hook 20 around the neck of a golfer. The opposite end of the rod 12 is connected to the putter head, using the attachment member 24 with the complementary separable fastener pad 26 which connects to the complementary separable fastener pad 28 on the upper portion of the club head. The length of the rod 12 is adjusted by telescopically moving the lower section 16 within the upper section 14. When an exact length is obtained, the sections are held in place relative to each other through the friction joint 18. The golfer grips the handle of the putter in a normal manner and commences a putting stroke. The practice putting training device 10 keeps the putter head on a precise path, both backward and forward through the arc of the stroke by pivoting around a central position, as defined by the head of the golfer within the loop 20. The connection of the rod 12 to the putter head also tends to keep the putter head aligned so that the putter face is not open or closed during the execution of the stroke. Thus, two of the three most important parameters of the putting stroke, that is, path and face angle, are maintained straight with respect to a preselected target line. Any attempt by the golfer to deviate from a straight path or to open or close the putter face will encounter resistance by the putting device 10, and thereby teach the golfer the feeling of a stroke which is precise and which sends the golf ball on the preselected target line when it is struck. Repetitious use of the putting device of the present invention will develop muscle memory, which will then aid the golfer in making the same consistent stroke, even when the device is not being used.

Another common fault in putting is the breaking down of the wrists of the golfer when the putter head is either swung back in the backswing or swung forward during the forward swing, rather than using the larger arm and shoulder muscles. The present invention includes an indicator loop 40 having side legs 42 and 44 which is rotatably coupled to the lower section 16 of the rod 12 using a bushing 46. By positioning the indicator loop 40 so that it surrounds the shaft 48 of the putter 30, a golfer can readily determine if the position of the putter shaft stays constant with respect to his shoulders and upper body torso by monitoring the position of the putter shaft within the indicator loop 40 as a stroke is made. The putter shaft is centrally positioned in the indicator loop 40 by simply rotating the loop around the lower section 16. If there is no deviation of the putter shaft 48 relative to the loop 40, there has been essentially no movement of the wrists or hands, and the larger upper body muscles were used to perform the stroke. However, if the hands or wrists break down, either in the back or forward swing, the putter shaft 48 will move toward one or other of the side legs 42 or 44 of the indicator loop 40, thereby providing the golfer with immediate feedback of the putting stroke being made. Here again, repetitive use of the putting device will ensure that a stroke is developed whereby the hands and wrists do not move and the putter is maintained on the predetermined desired target line.

FIG. 4 illustrates an alternate attachment arrangement for connecting the lower end of a rod 112 directly to the putter head. It will be appreciated that the upper portion of the device, including the neck engaging loop in this alternate embodiment, is the same as disclosed in the description of FIGS. 1 to 3. The lower end of the rod 112 includes a flexible coupling 150 which is threadedly attached to the rod 112 by male threads 152 which engage female threads 154 in the flexible coupling 150. The coupling, in turn, is threadedly attached to the attachment member 124 by means of male threads 156 on the flexible coupling 150 which cooperate with a threaded opening 158 in the attachment member 124. As with the first embodiment, the attachment member includes a complementary separable fastener section 126 which cooperates with a second separable fastener member 128 formed on the putter head 130. The flexible coupling allows rougher handling of the practice device, particularly by beginning golfers before they become familiar with the way the device is used.

Figure 2:
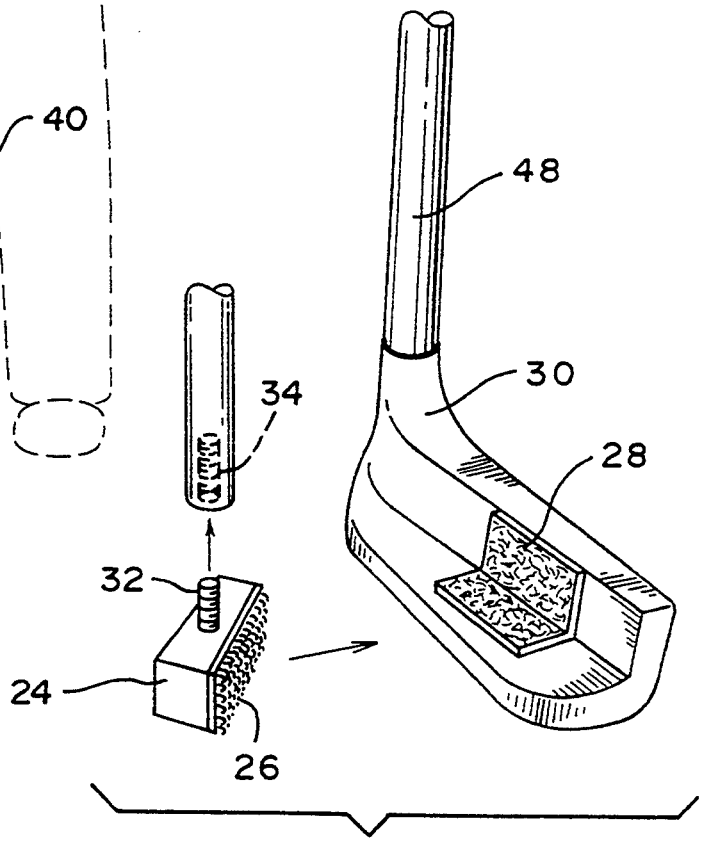
FIG. 2 is a detail of the device and a putter to which the device of FIG. 1 is connected.

FIG. 5 illustrates a second alternative embodiment of the practice device which is essentially similar to that described with respect to FIGS. 1 to 3, except that there is a permanent connection to a putter head 230 by means of a threaded rod or screw 260 which is integrally formed or permanently attached to the back of the putter head. The threaded rod cooperates with internal threads 264 on a flexible coupling 266, which in turn, is connected to threads 268 on the lower end of a rod 212. This arrangement provides a permanently attached putting device for teachers, instructors and schools, allowing a student to use the teaching device without having to modify their own personal putter. As with the previous embodiment, the flexible tubing permits the device to be more receptive to rough use, such as may occur in a relatively large number of different students who are trained with this invention.

It will be appreciated that various changes and modifications may be made to the putting device of the present invention. For example, the connector need not be a separable fastener, but the device would work equally well with any type of rigid connection between the end of the device and the putter head. Similarly, the device could work equally well with a different type of connector to the central rotational point on the golfer. Other modifications may be made to the invention in keeping within the scope of the following claims.

I claim:

1. A device for use with a golf putter having a putter head and a shaft;

said device for determining the position of a golfer's hands during the execution of a putting stroke along a preselected path and for maintaining the putter head in a precise relationship on that path with respect to the golfer to develop a repetitive stroke comprising:

a neck engaging member;

an elongated rod having first and second ends, said first end connected to the neck engaging member;

the length of the elongated rod defining the radius of the arc of motion of the putter relative to the golfer;

a quick release connector for releasably connecting the second end of the rod to the putter head; and, an indicator attachable to the elongated rod for determining the position of the golf putter shaft relative to the central pivot point defining the radius of arc of motion of the putter, said indicator being an elongated loop having elongated sides;

a fixed end of said loop attached to said rod and a free end of said loop forming an opening with respect to the fixed end whereby the opening is structured to receive the putter head shaft when the device is used, said putter shaft being centrally positioned relative to the elongated sides of the indicator loop and whereby said putter shaft maintains its position relative to the indicator loop during the execution of a proper golf putting stroke and whereby the shaft moves to either one of said elongated sides of said indicator loop when an improper putting stroke is made.

2. The device of claim 1 wherein the elongated rod is formed of two telescoping members frictionally connected to each other by a friction joint.

3. The device of claim 1 wherein the quick release connector is a separable fastener.

4. The device of claim 3 wherein the separable fastener includes a complimentary separable fastener section connected to the end of the elongated rod and a second complimentary separable fastener section adopted to be connected to the putter head.

5. The device of claim 1 wherein the neck engaging member is a loop having an opening sized to permit the loop to the placed around the neck of the golfer.

6. The device of claim 8 wherein the quick release connector is attachable to the end of the elongated rod opposite the loop.

7. The device of claim 1 wherein the indicator loop includes a means for rotatably positioning the loop on the rod.

8. The device of claim 1 further including a flexible coupling adapted to be located between said elongated rod and the putter head.

9. The device of claim 1 wherein the quick release connector is a threaded coupling.

10. A device for practicing a golf putting stroke with a golf putter having a putter head and a shaft and for determining the position of a golfer's hands during the execution of a putting stroke along a preselected path while maintaining the putter head in a precise relationship on that path with respect to the golfer to develop a repetitive stroke comprising:

a neck engaging member;

an elongated rod having one end connected with said neck engaging member.

a quick release connector for releasably connecting an opposite end of the rod to the putter head; and, an indicator affixed to said elongated rod and having spaced members; an opening between said spaced members to receive the shaft of the putter therebetween at a predetermined distance between said spaced members prior to the execution of the putting stroke; variations in the distance of the shaft between said spaced members providing an indication of the movement of the position of the golfer's hands during the execution of the stroke.

11. The device of claim 10 wherein said indicator is an elongated rigid loop having spaced legs forming said spaced members.

* * * * *